US007384017B1

(12) United States Patent
Burke et al.

(10) Patent No.: US 7,384,017 B1
(45) Date of Patent: Jun. 10, 2008

(54) RETRACTABLE GATE

(75) Inventors: Thomas J. Burke, Whitehouse Station, NJ (US); John Dinunzi, Easton, PA (US)

(73) Assignee: Safe-Crossings, LLC, Newark, NJ (US)

( * ) Notice: Subject to any disclaimer, the term of this patent is extended or adjusted under 35 U.S.C. 154(b) by 355 days.

(21) Appl. No.: 11/150,702

(22) Filed: Jun. 13, 2005

(51) Int. Cl.
*B61L 23/00* (2006.01)

(52) U.S. Cl. ..... 246/125; 246/127; 246/293; 49/49

(58) Field of Classification Search ..... 246/473.1, 246/293, 294, 125, 127; 49/49, 34, 332
See application file for complete search history.

(56) References Cited

U.S. PATENT DOCUMENTS 494,390 A 3/1893 Smith
1,536,360 A * 5/1925 Stewart ..... 49/324
1,628,651 A * 5/1927 Burress ..... 49/9
4,666,108 A 5/1987 Fox
6,142,426 A 11/2000 Zart et al.
6,189,839 B1 * 2/2001 Lemieux ..... 246/293
6,618,993 B2 9/2003 Burke
2005/0139730 A1 * 6/2005 Zarkades ..... 246/473.1

* cited by examiner

*Primary Examiner*—Mark Le
(74) *Attorney, Agent, or Firm*—Joanne M. Martin

(57) ABSTRACT

A retractable gate comprising a movable arm gate having multiple sections which nest or telescope into each other when parked (e.g. upright), and extends into a full length blocking position as it is deployed. The gate arm sections are deployed by the movement of one of the arms, e.g. the outer one section, relative to the ground or a stationary support member and is joined to the stationary support member by a pivot point or bearing, and is connected to the stationary support or ground by a cable connection (or equivalent) which powers the arm sections into extended or retracted positions by movement of the gate about the pivot bearing. A novel corresponding counterweight system provides selectable balance and torque requirements.

15 Claims, 6 Drawing Sheets

Set-up always includes two (2) 36" x 12" x 1/2" plates on each side to anchor all other counterweights - one on centerline of the gate arm slot and the other at 90 degrees from the gate arm slot Refer to chart indicating the weight in Position A-1, A-2, and B for both the right and left side of the mechanism

Set-up always includes two (2) 36" x 12" x 1/2" plates on each side to anchor all other counterweights - one on centerline of the gate arm slot and the other at 90 degrees from the gate arm slot

Refer to chart indicating the weight in Position A-1, A-2, and B for both the right and left side of the mechanism

Counterweight Dimensions

Counterweight Plate A: 36" x 12" x 1/2"

Weight of Plate is 65 pounds

Counterweight Plate B: 22" x 19" x 1/2"

Weight of Plate is 65 pounds

Counterweight Plate C: 22" x 19" x 3/4", Weight is 97.5 lbs

Counterweight Plate D: 22" x 19" x 3/4", Weight is 130 lbs

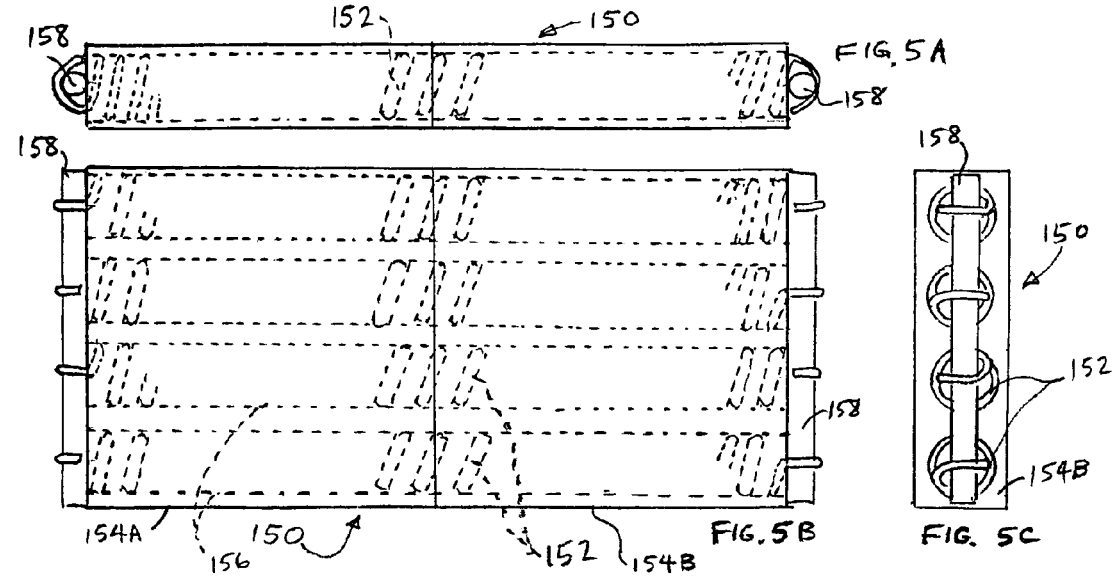
158
152
150
158
FIG. 5A
158
158
154A
156
150
152
154B
FIG. 5B
158
150
152
154B
FIG. 5C
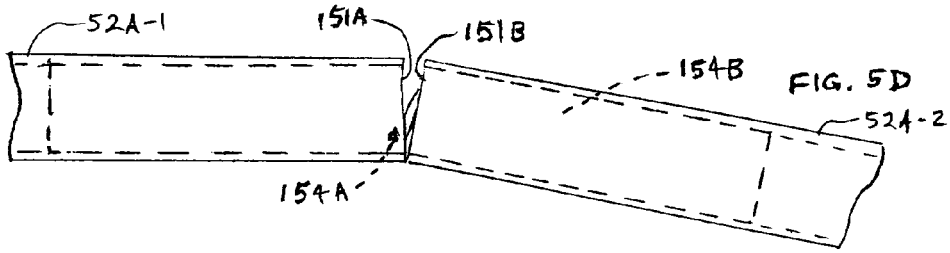
52A-1
151A
151B
154B
FIG. 5D
52A-2
154A
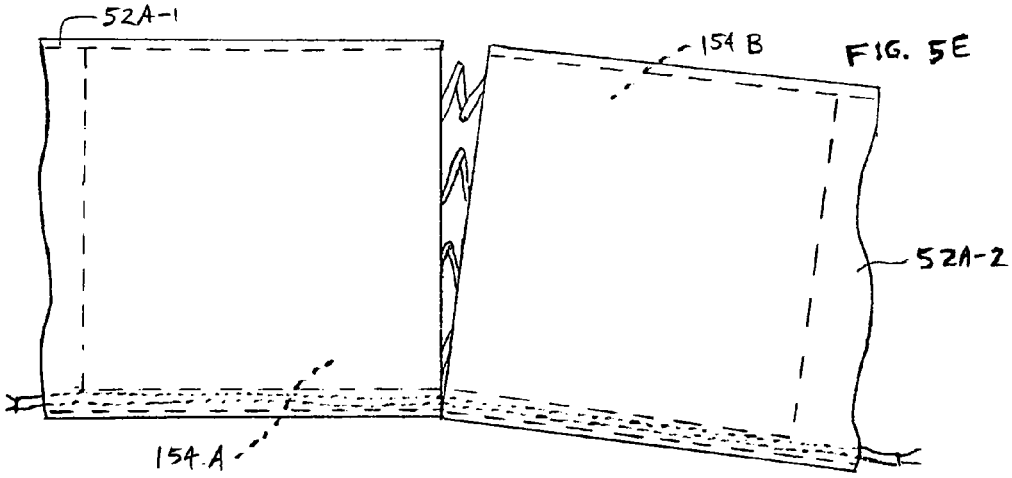
52A-1
154 B
FIG. 5E
52A-2
154 A

RETRACTABLE GATE

FIELD OF THE INVENTION

The present invention relates to movable arm gates, in particular to movable arm gates wherein the arm is retracted in length powered by, and in response to the gate movement.

BACKGROUND OF THE INVENTION

Movable arm gates, especially road gates for railroad crossing protection, are often required to extend over a significant expanse of horizontal surface, and to remove that gate completely to permit free travel over that surface within specified time limits. However, a long gate arm represents a considerable weight and movement inertia, which is further increased by added counter balances. Moreover, the moved gate requires a place to park when not positioned to block access. For vertically moving gates which are parked in an upright (or nearly upright) position, the upward motion is difficult especially in the initial stage of being raised from the horizontal, and significant vertical space above the gate is required. The weight and inertia and vertical space requirements of long arm style gates discourage and ultimately limit the gate arm length. Especially significant for the all gates, long or short, which are parked in the raised position is their vulnerability to wind and other weather related damage.

SUMMARY OF THE INVENTION

The retractable gate according to the present invention comprises an arm style gate having multiple sections which nest or telescope into each other when upright (or otherwise moved into a parked position), and extend into a full length deployed position as it is moved into the blocking position. The gate arm sections are extended or retracted by the movement of one of the arm sections, e.g., the outer one section, which is joined by a pivot point or bearing to a stationary support member, and by a cable connection (or other physical link) which provides the force to the arm sections as the gate is moved about the pivot bearing.

The retractable gate according to the present invention may be raised and lowered (or rotated) between block and park positions. While gravity provides motive forces for retraction (or extension as the gate is raised into the park position, alternate embodiments include further extension and retraction devices to broaden the applicability of the retractable gate according to the present invention.

Thus, the retractable gate provides reduced wind loading, less space requirement when in the park position, a reduced inertia moment arm by retractable arm sections which are deployed or retracted without requiring additional time to deploy the arm sections in the blocking position.

BRIEF DESCRIPTION OF THE DRAWING

These and further features of the present invention will be better understood by reading the following Detailed Description together with the Drawing, wherein.

DETAILED DESCRIPTION OF THE INVENTION

Figure 1:
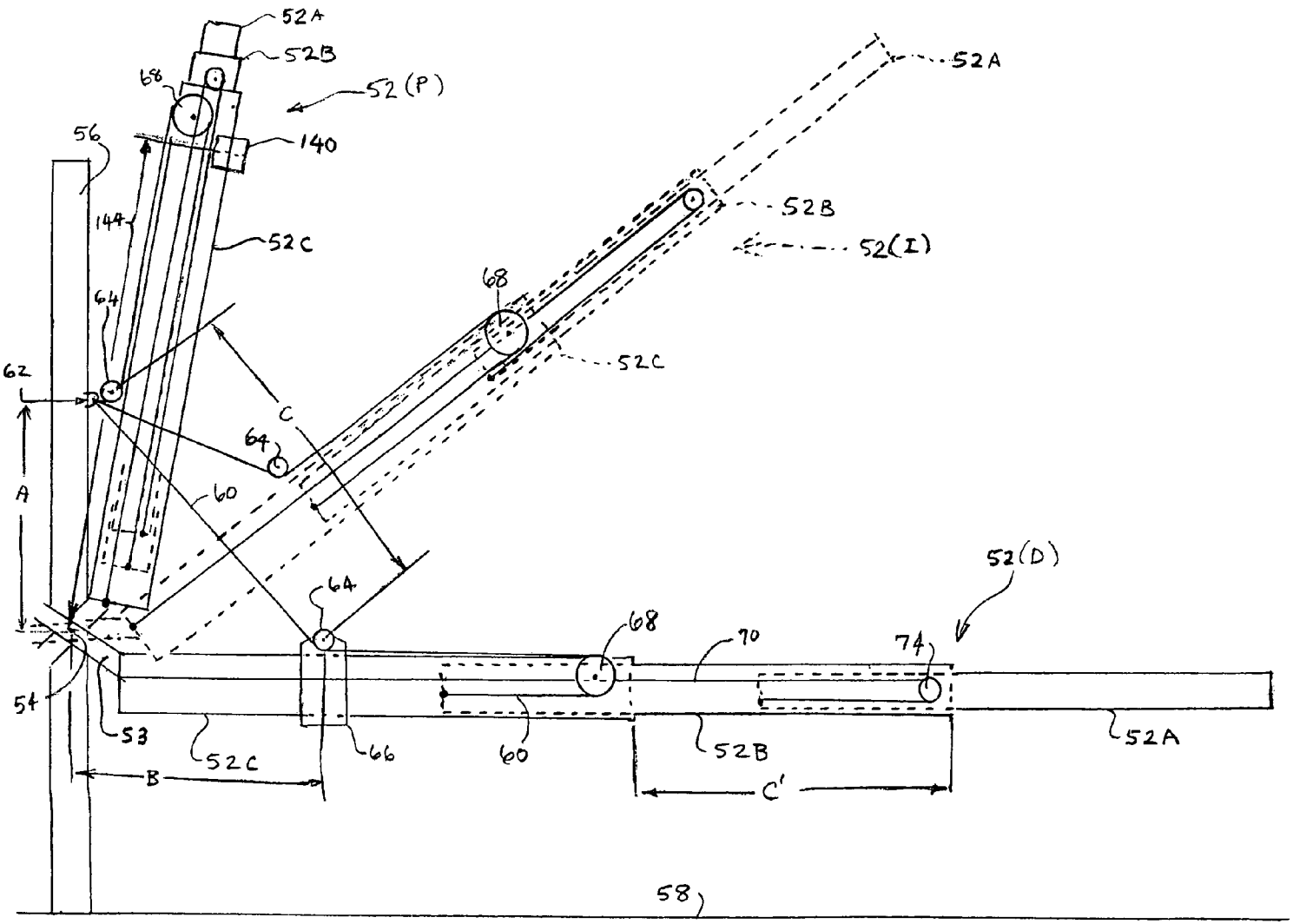
FIG. 1 is an elevation view of one embodiment of the present invention, showing exemplary extension elements with the gate arms in a parked upright position, an intermediate transitional position, and a blocking (deployed) position.
Figure 2:
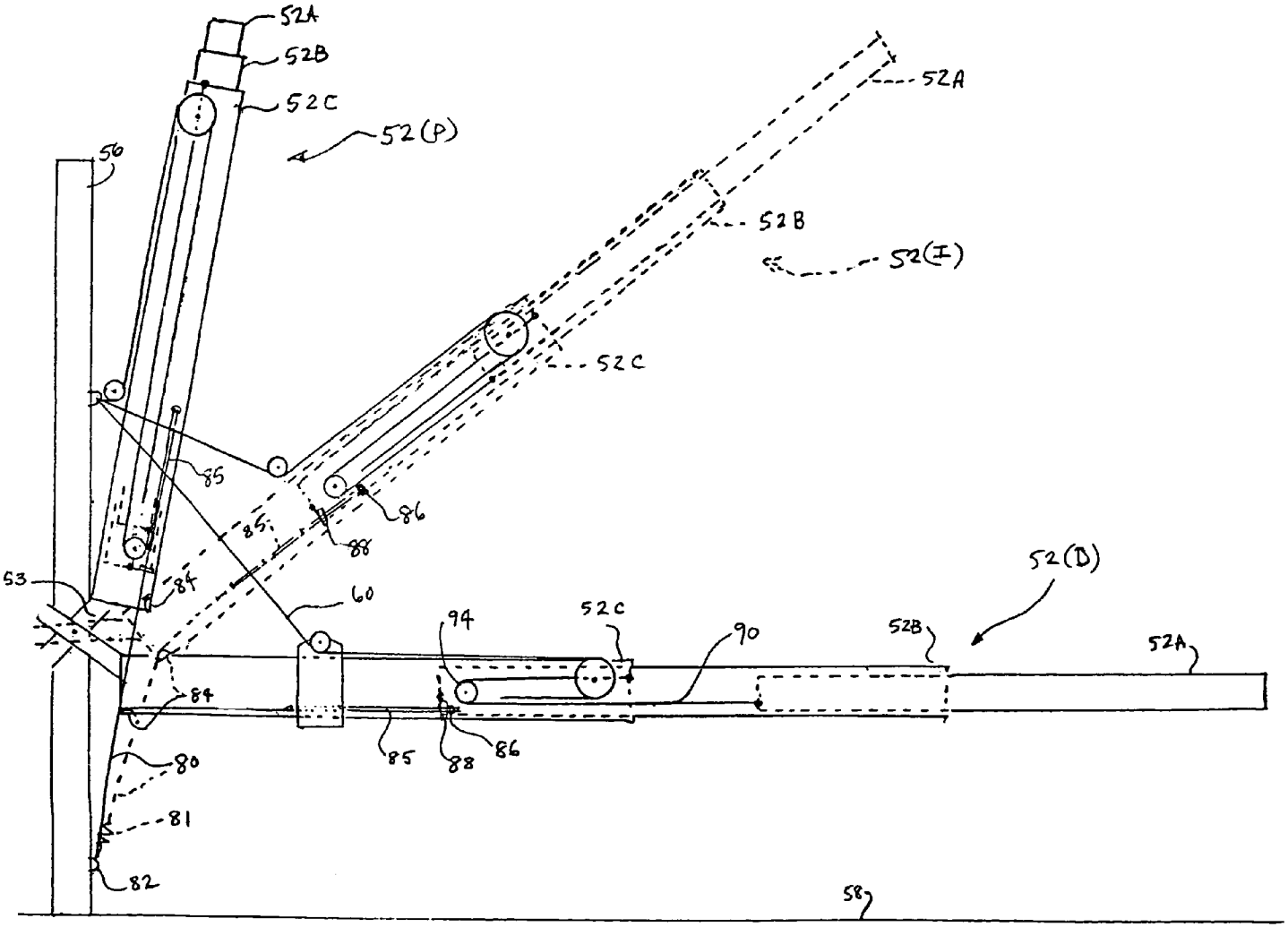
FIG. 2 is an elevation view of one embodiment of the present invention, showing exemplary retraction elements with the gate arms in a parked upright position, an intermediate transitional position, and a blocking (deployed) position.
Figure 3:
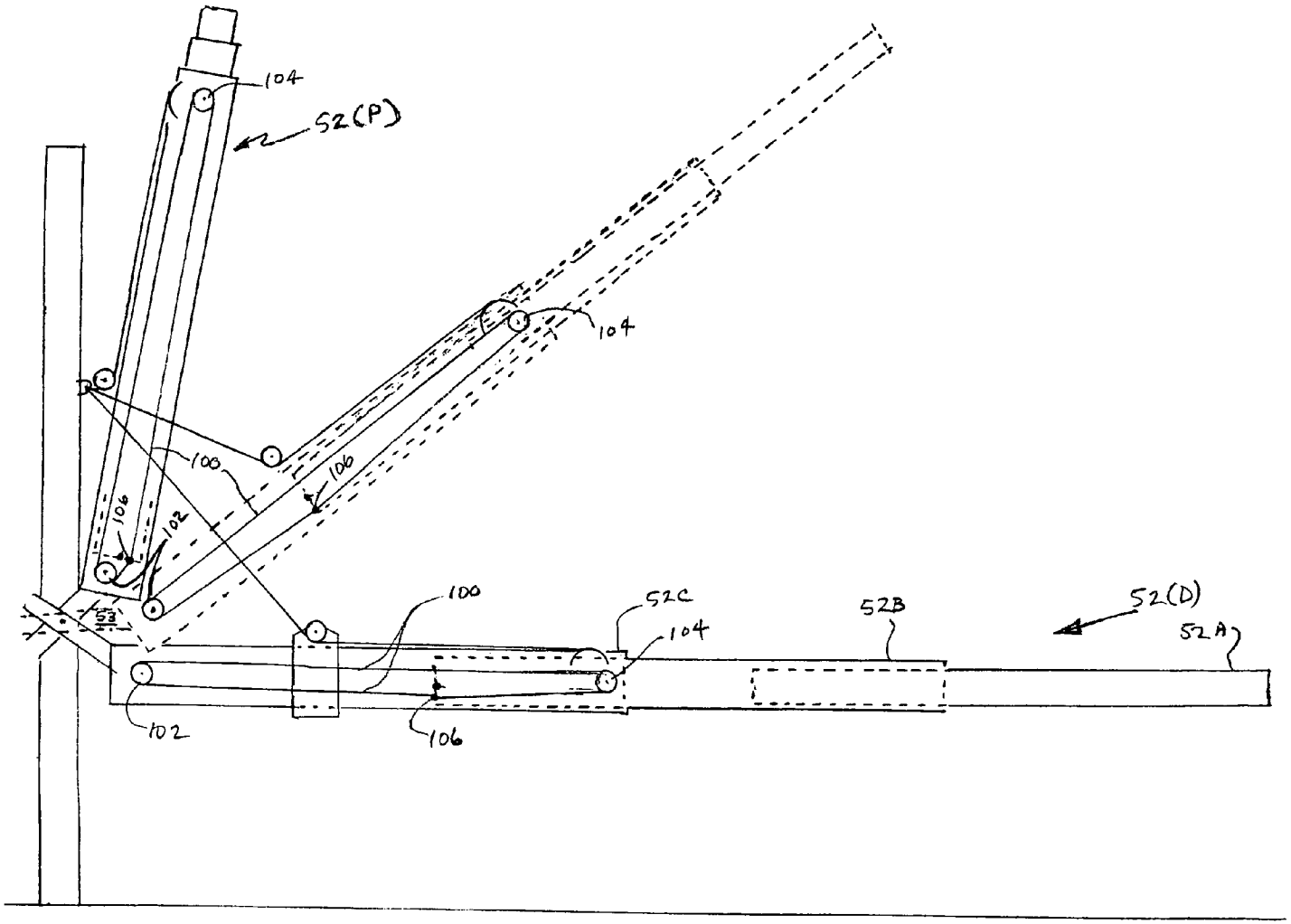
FIG. 3 is an elevation view of one embodiment of the present invention, showing exemplary motor assist elements with the gate arms in a parked upright position, an intermediate transitional position, and a blocking (deployed) position.

The exemplary embodiment of FIGS. 1, 2 and 3 showing the gate arm 52 in lowered (blocking) 52(D), intermediate 52(I), and raised up (parked) 52(P) positions. In the exemplary embodiment of FIGS. 1, 2 and 3, the retractable gate arm comprises three tubular segments, 52A, 52B and 52C in which section 52A retracts into section 52B, which retracts into section 52C. Alternate embodiments also include, without limitation, U-shaped, beam, rectangular planar, etc arm section cross-sections, straight or curved along the length of the sections, which may retract adjacent to, over, or any other configuration provided by one skilled in the art. The gate arm 52 includes an end portion 53 which allows the arm 52 to pivot about a pivot 54 and offsets the axis (extending through the center of the arm sections 52A, 52B and 53C) centerline from the pivot 54 so as not to extend therethrough. Moreover, although the embodiment shows the gate arm 52(P) raised substantially perpendicular to the ground 58, other embodiments do not necessarily limit the range of or parking positions of the gate arm. Moreover, the gate arms 52(P), 52(I) or 52(D) may also pivot parallel to the ground 58, or any intermediate orientation. For clarity, each of the FIGS. 1, 2 and 3 show different exemplary internal structure and devices according to the present invention, which are typically combined on and in a single structure. A counterweight system is provided as discussed, below, and illustrated in FIGS. 4, 4A and 4B and connects to the arm 52 via offset portion 53.

Cable 60 attaches to a support member 56 at a connector 62 a selected distance A from the pivot 54 and proceeds through a first pulley 64 retained by a movable collar 66 retained by and securable to the arm section 52C. The cable 60 then proceeds along the arm section 52C and around a second pulley 68 attached to the second end (distal to the pivot 54) of the gate arm section 52C to travel through the arm section 52C in a reverse direction until terminating at the first (proximal to the pivot) end of the second or next concentrically disposed gate arm section 52B. As can be seen for the arm 52(P) parked in the up position, the distance C between the cable connector 62 and the first pulley 64 is minimal, allowing the second section 52B of the gate arm to retract into the outer section 52C. As the gate arm is extended through the intermediate positions (e.g. 52(I)), the distance C increases, shortening the cable and pulling the proximal end of the second section 52B toward the distal (second) end of the first section 52C, causing it to extend until the gate arm 52A is finally fully deployed.

In the embodiment shown, the distances A and B are substantially equal to allow the cable length C to become minimized when the gate is parked. However, alternate embodiments wherein different distances A and B are within the scope of the present invention. Thus, the distance C (the third side of a triangle) is readily calculable and corresponds to the amount of extension for the arm section 52B to which the cable terminates.

The typical gate cable installation proceeds as follows. With the second pulley attached, but movable along the arm section 52C, move the pulley to the second (distal) end. Determine the extension (C') desired of the arm section to which the end of the cable is affixed, which in the present embodiment will equal the maximum C distance (52(D)) minus the minimum C distance (virtually zero for 52(P). Pythagoras says $A^2+B^2=C^2$, and in the present embodiment, distances B=A, so $2B^2=C^2$ and therefore B (and also A)=sqrt ($\frac{1}{2}C^2$), and the distances A and B are so adjusted, the second pulley 64 being locked or secured into position along arm section 52A and the cable connector 62 being so affixed. For instance, if the desired extension of one section is 14 feet (C), the A and B dimensions are about 9.9 feet. In alternate embodiments where the dimensions for A and B are not the same, the geometric disposition of the cable connector 62 and the pulley 64 relative to the pivot 54 are readily determined according to the present invention by one of skill in the art.

A further extension device for extending the next inner section 52A from the second section 52B is also shown in FIG. 1. A second cable 70, connected to the first (proximal) end of the outer arm section 52C and extends forward towards the second (distal) end where a third pulley 74 is mounted on the second (distal) end of the second arm section 52B. The second cable 70 extends around the pulley 74 and returns back toward the first end, but connects to the first (proximal) end of the third arm section 52A. As the second arm section 52B is extended by operation of cable 60, the pulley 74 is moved away from the first end of the outer arm section 52C, causing the cable 70 to pull the next inner arm 52A out of the second arm section 52B.

When the gate arms 52A, 52B and 52C are moved into the park position away from the blocking position by motive devices, e.g. motors, hydraulics, etc. (not shown), the sequence of events reverses, which if the gate is raised upright to park, can occur simply by allowing the force of gravity to draw the inner sections 52A and 52B downward into the outer arm section 52C. One supplemental retraction device is shown in FIG. 2, wherein a third cable 80 is anchored to the support 56 by connector 82 (or even directly to the ground 58) and extends over a slide support guide (or pulley) 84 and forward toward the second end of the outer arm section 52C, attaching to a slide rod 85 which passes through a stop 88 and has a terminating nut 86 on the other (distal) side of the stop. The stop 88 is mounted to the first (proximal) end of the second arm section 52B. As the retractable gate 52(D) is moved to the park position (52(P)), the total distance (in the deployed blocking position) between the stop 88, the support guide 84 and the end of the cable 80 (e.g. at connector 82) increases, causing the cable 80 to pull back (to the proximal end of 52C) on arm section 52B. In certain alternative geometrical embodiments wherein the gate retraction or extension causes the third cable 80 to exert a force on the first cable 60, additional resilient expandable devices, e.g. a spring (not shown), may be inserted into the third cable to accommodate any need for additional cable lengths (of either first or third cables). In horizontally moving gates, an resilient expandable device may be inserted into the first cable 60.

A further retraction device is also shown in FIG. 2, including a fourth cable 90 connected to the second (distal) end of the outer arm support 52C and proceeds to the first end to a pulley 94 mounted on the proximal end of the second arm support 52B before returning distally until it is connected to the first (proximal) end of the next inner arm support 52A. When the gate 52(D) is retracted, as with the operation of cable 70 described above, as the second arm support 52B is retracting and moves the pulley 94 away from the second end of the outer arm support 52C and cable 90 being of fixed length, cable 90 will pull the next inner support arm 52A into the second arm section 52B.

A motion assist device for either extension or retraction is shown in FIG. 3, comprising a motor-driven pulley 102 connected to the first end of the outer arm support 52C and a pulley 104 mounted at or near the second end of the outer arm support 52C, and a cable or belt therearound, being fastened at a point 106 at or near the first end of the second arm support 52B. Alternate embodiments may place the drive motor (not shown) at the pulley 104. The force applied to the cable 100 urges the second support arm to retract or extend, and can be used to supplement or initiate the motions of the inner support arms 52B and 52C which become directed by the pulley-and-cable systems described elsewhere herein, and may include a releasable coupling, not shown, (e.g. on the motor, pulleys, or fasten point 106) so that the movement of the arm sections is not hindered by motor drag. Moreover, when combined with the operation of the first 60 or third cable 80, alone or in combination, the motor-driven pulley, by driving the extension or retraction of the second arm support 52B which is in turn connected to the support 56 or ground 58 according to the present invention, may provide at least some of the movement energy required to move the gate 52(D) into the parked gate 52(P) position and back.

Figure 4:
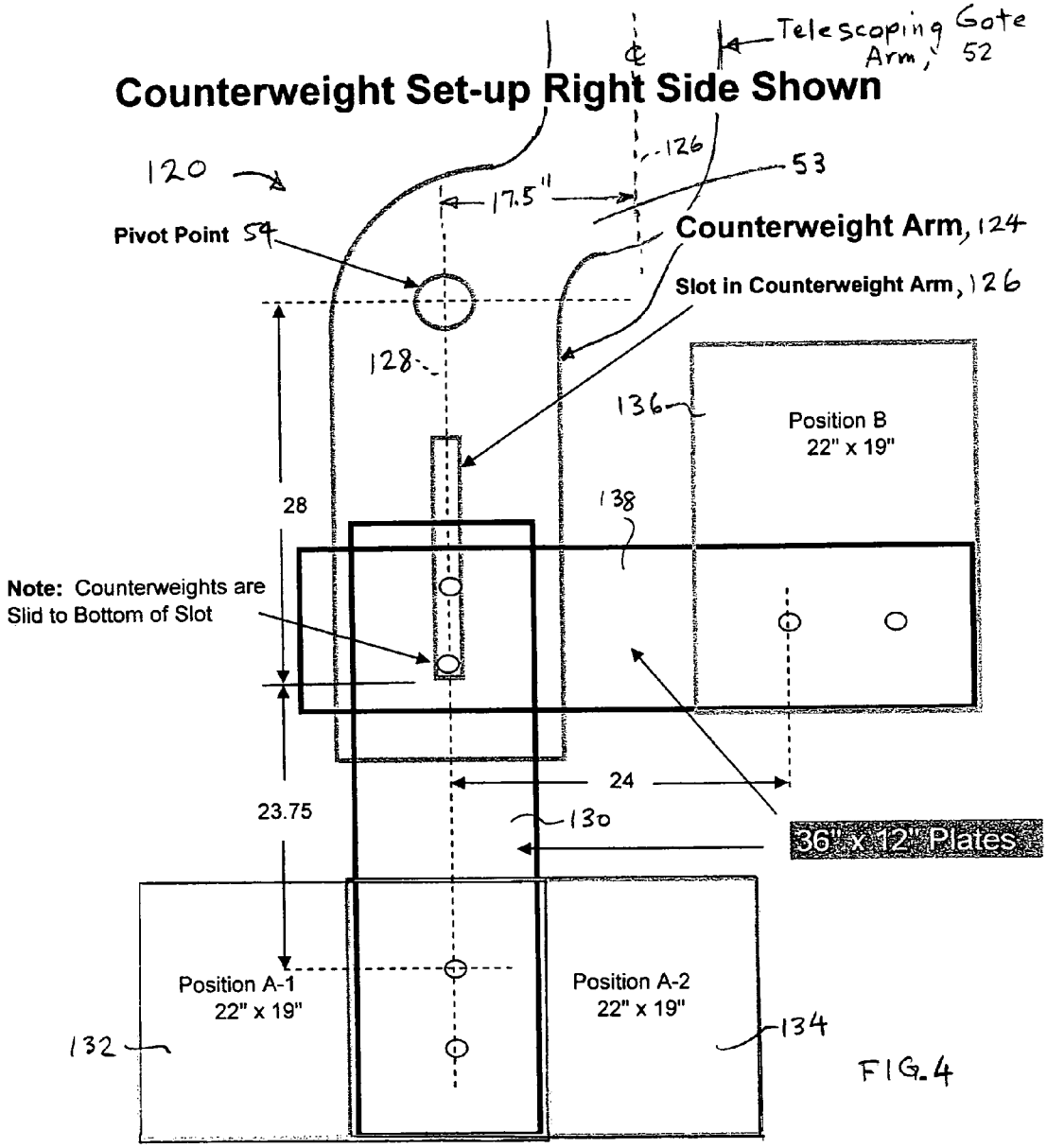
FIG. 4 is an elevation view of one embodiment of the gate counterweights with the gate in the upright position.

Further details relating to the deployment of the gate arm counterweights and weight orientation is shown in FIG. 4, with the gate arm 52, mounted on upper offset section 53 extends toward a counterweight arm 124 which receives the counterweights thereon, and is movable about a counterweight pivot 54 point to raise the gate into an upright position and into a blocking (down) position by movement about the pivot 54 point. The center line 126 of the telescoping gate arm 52 is offset by the section 53 in the present exemplary embodiment by 17.5 inches, or another dimension may be selected according to the present invention along with the weight and dimensions of the telescoping arm sections and the selection of and deployment of the weights as described below to achieve the desired gate torque and other characteristics.

The embodiment of FIG. 4 includes 5 weights deployed at various positions along and distances from the counterweight arm vertical axis 128 (extending vertically through the pivot 54 point when the counterweight arm 124 is vertically oriented). The long axis of the rectangular (12"× 36", 65 lb.) counterweight 130 is disposed on the rear section 124 centered along the vertical axis 128 and slidably adjustable in counterweight arm slot 126 (being 18 inches in length in the present embodiment) to be spaced a greater or lesser distance relative to the pivot 54 point. Rectangular weights 132 and 134, having a dimension of 22"×19" and weighing 65 pounds in the present embodiment, are positioned with their longer dimension perpendicular to the axis 128, the weight 132 with 16/22 of the weight extending to one side of the axis 128 and 16/22 of the other weight 134 extending to the other side of the axis 128, and may be modified with the other weights and dimensions of the present invention to achieve the desired torque and other gate characteristics as described below.

The long axis of the rectangular (12"×36", 65 lb.) counterweight 138 is disposed on the counterweight arm 124 with its longer dimension perpendicular to the vertical axis 128, with 28/36 of the weight being extending away from the axis 128 and (toward axis 126), and slidably adjustable in counterweight arm slot 126 to be spaced a greater or lesser distance relative to the pivot 54 point. Rectangular weight 136, having a dimension of 22"×19" and weighing 65 pounds in the present embodiment, is positioned with its longer dimension parallel to the axis 128 and on the other side of the arm axis 126, the weight 132 with 16/22 of the weight extending to one side of the axis through the long dimension of the weight 138.

Figure 4A:
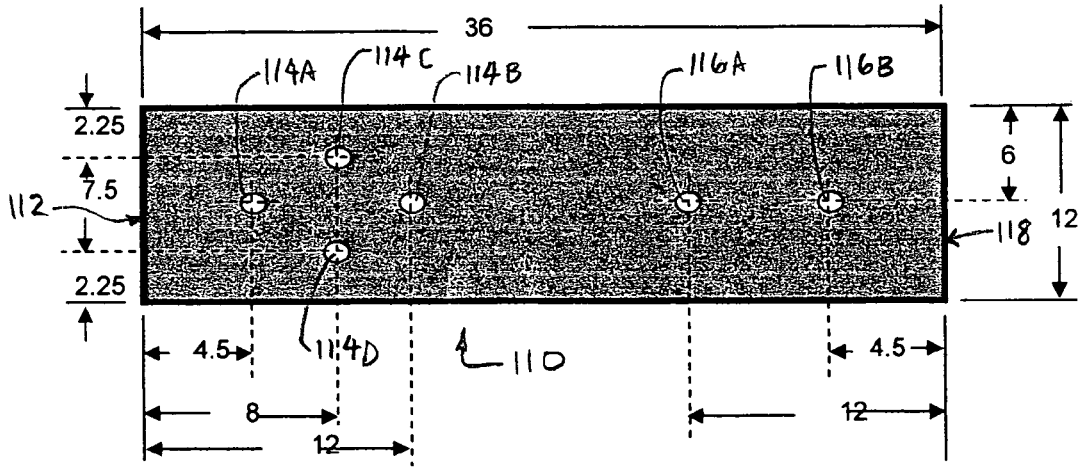
FIG. 4A is an elevation view of a first counterweight of the embodiment of FIG. 4.

Further details of the exemplary weights 130 and 138 are shown as weight 110 in FIG. 4A, having exemplary dimensions of 12" wide and length (between ends 112 and 118) of 36" and uniform weight distribution over the area of the weight. Holes 114A and 114B are used when deployed as weight 130 and mounted to arm 124 in slot 126, and include holes 116A and 116B for mounting to weights 132 and 134, (or 136) as described, above. Holes 114C and 114D are used to connect to the arm 124 via slot 126 when the weight 110 is mounted perpendicular to the axis 128 as weight 138. The center line of holes 114C and 114D, and the midpoint between holes 114A and 114B is 8" from the end 112.

Figure 4B:
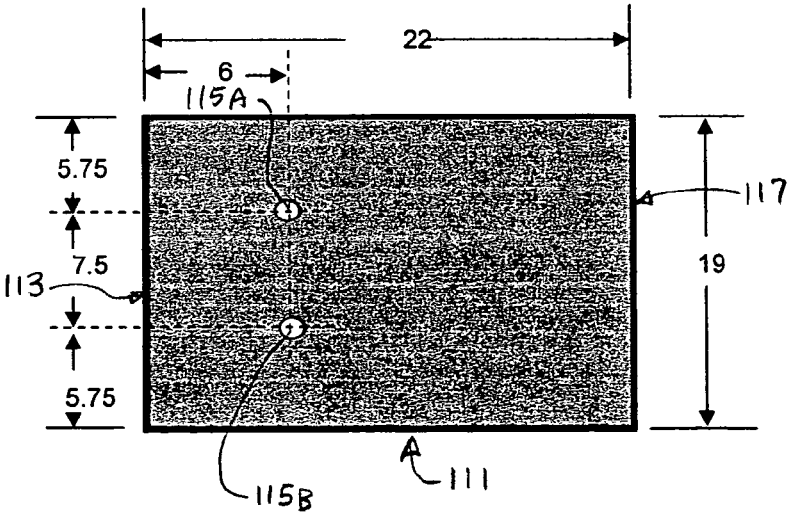
FIG. 4B is an elevation view of a second counterweight of the embodiment of FIG. 4.
Figure 1:
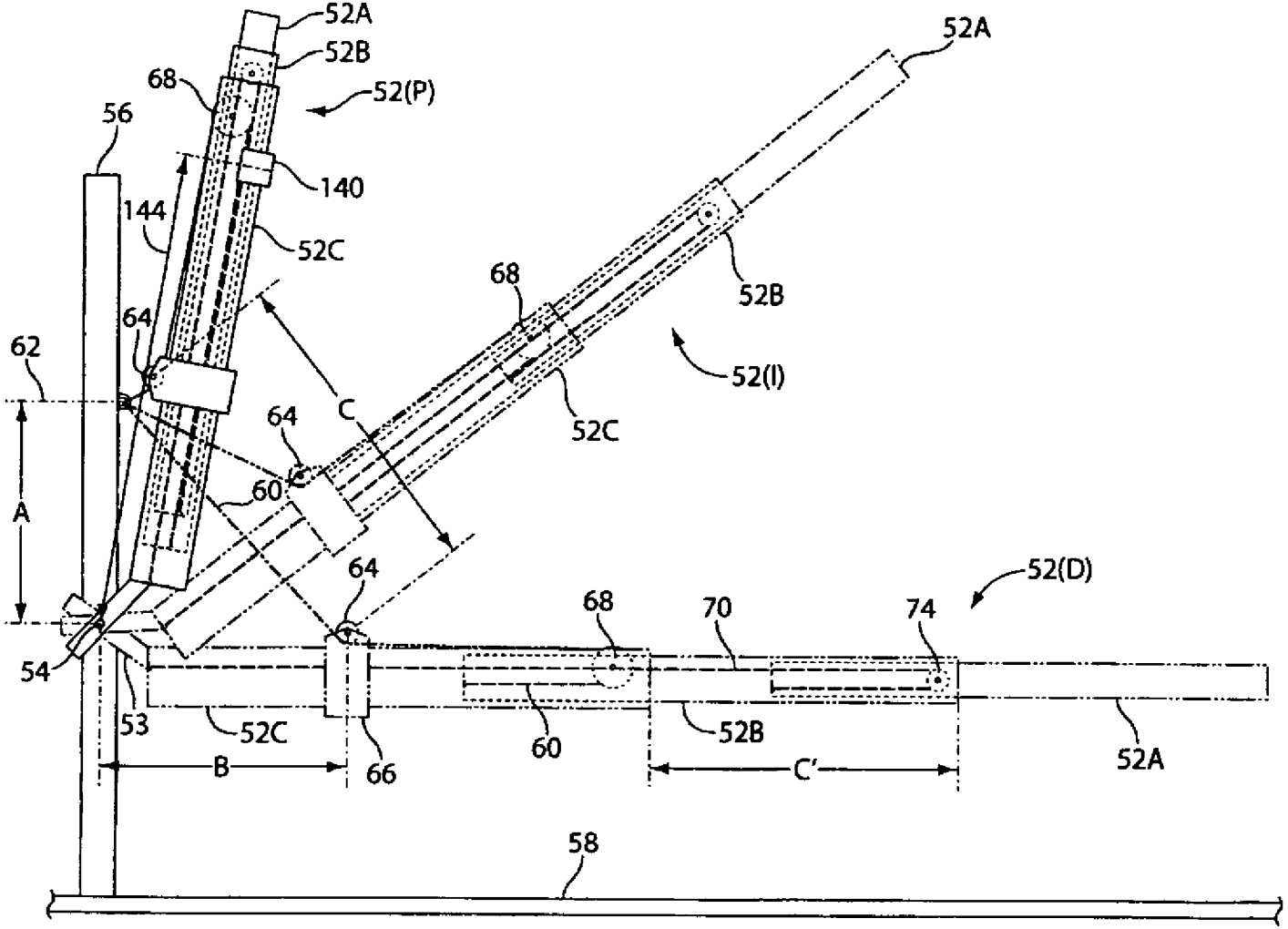
Figure 2:
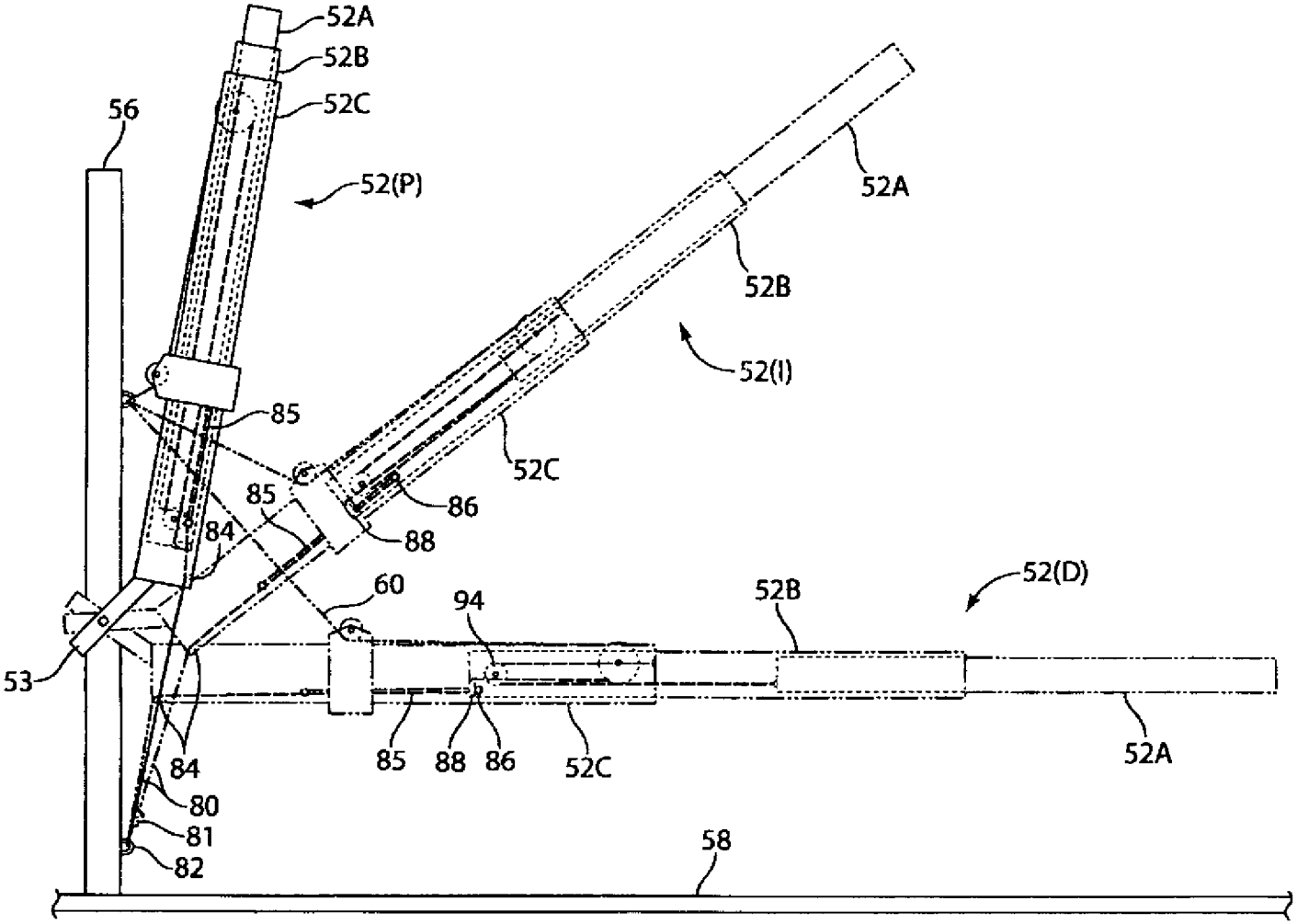
Figure 3:
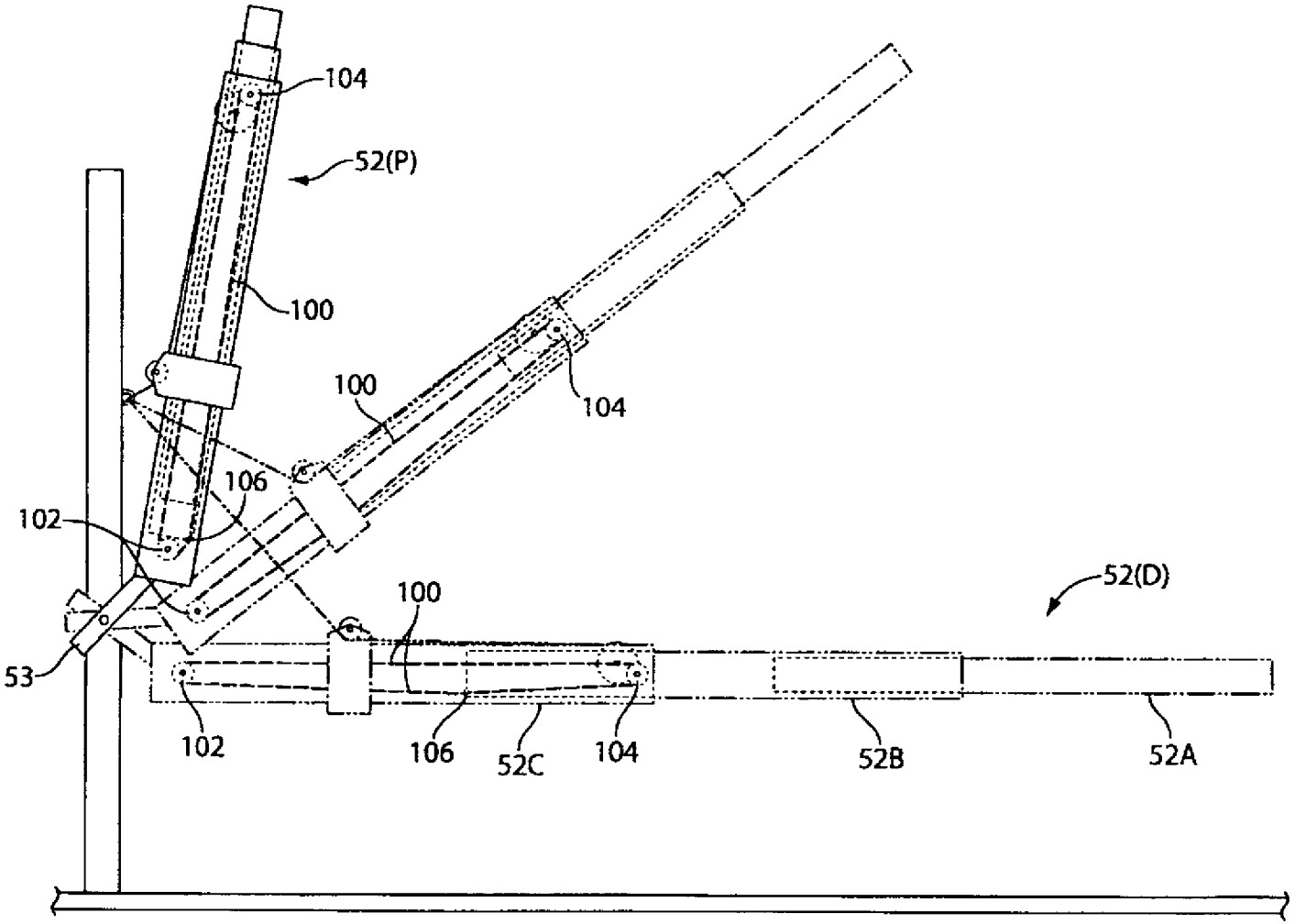
Figure 4:
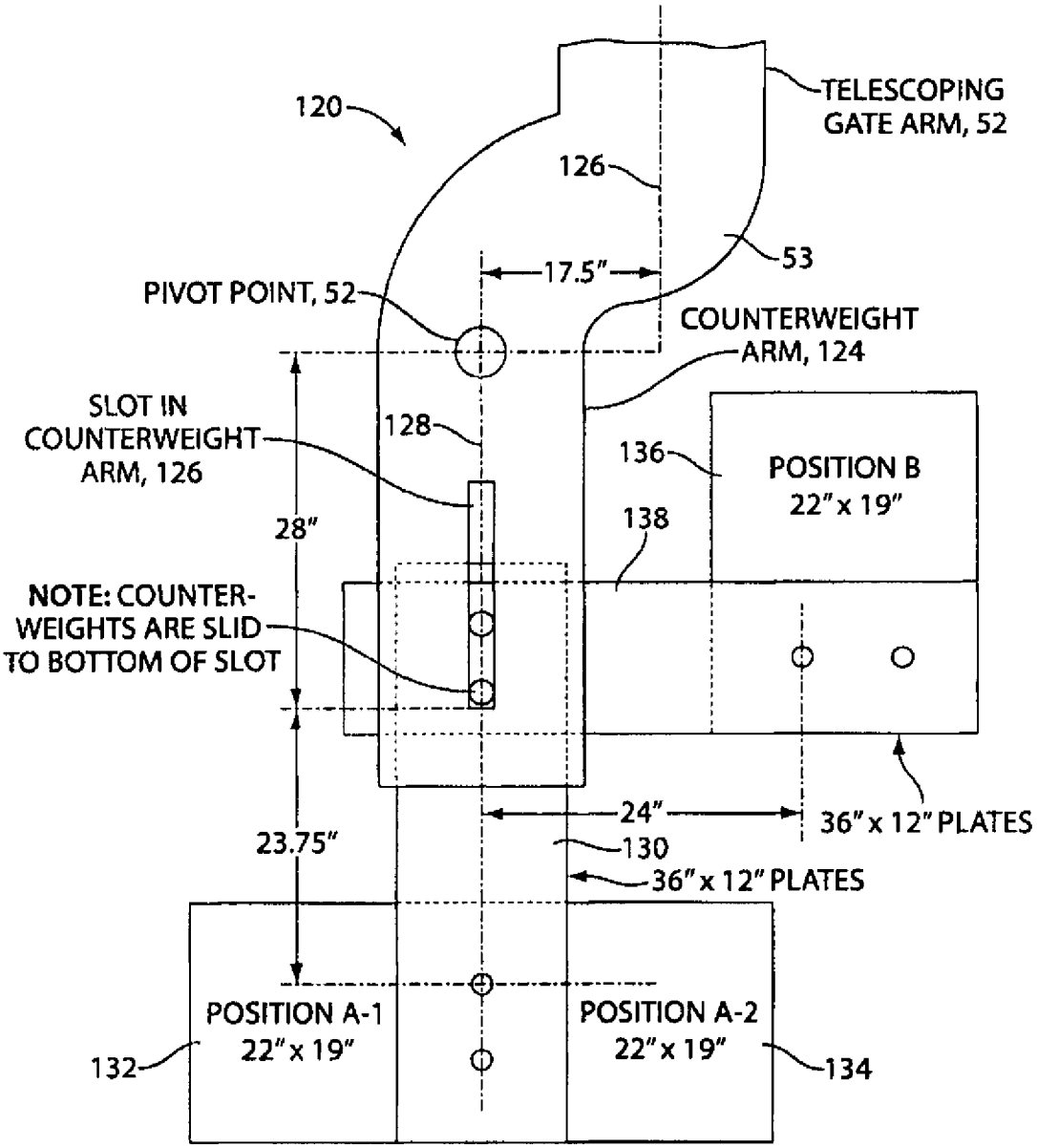
Figure 4A:
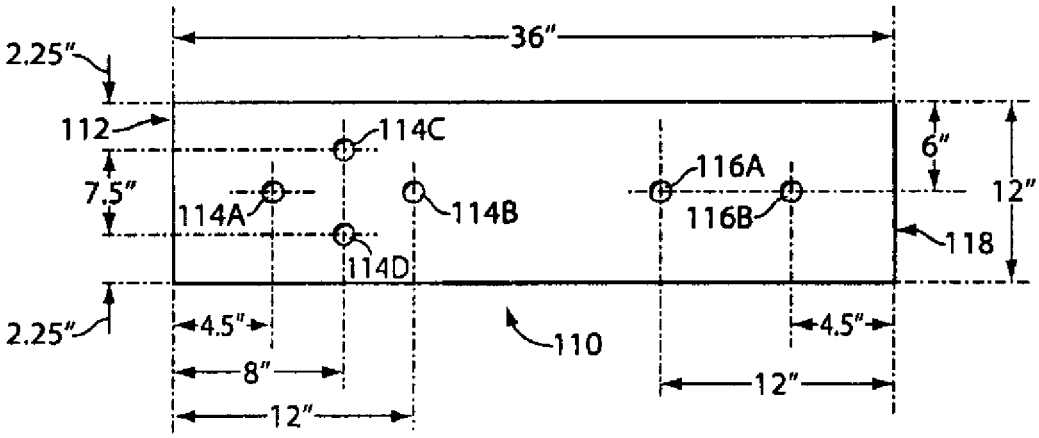
Figure 4B:
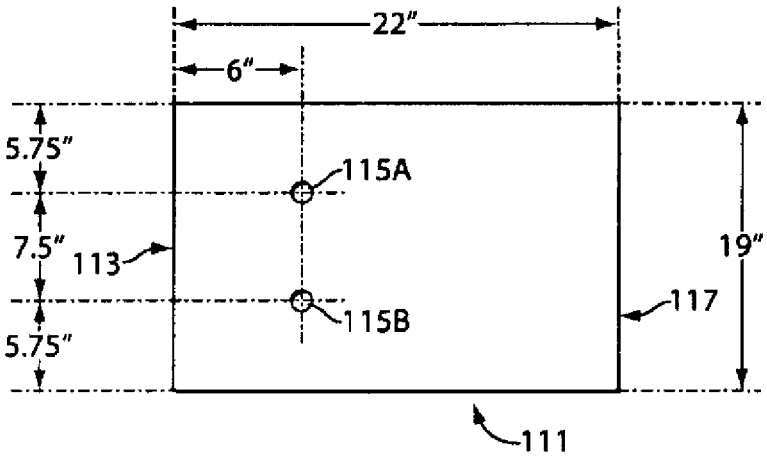

Further details of the exemplary weights 132, 134 and 136 are shown the weight 111 of FIG. 4B, having an exemplary dimension of 19" wide and 22" long (between ends 113 and 117) and uniform weight distribution over the area of the weight. The center line of the holes 115A and 115B is 6" from the end 113 of weight 111, and are otherwise together centered in the other (19") dimension.

Typically, governmental standards require that the gate have a down "fail" position, when the power to operate or move the gate into the upright position is lost, so that the gate arm 52 deployed down (blocking) and fully extended. Further typical requirements require a lifting force from a down position (vertical torque) of 400 to 480 ft-lbs, and a force to maintain the gate up (horizontal torque) of 80 to 120 ft-lbs. A further inventive feature of the present invention is the addition of a supplemental weight 140, shown in FIG. 1, deployed along the section 52C a distance 144 from the pivot 54, of 12' 5" (center of weight) relative to the pivot 54 as measured along the axis of the gate arm 52 (not including the distance added by the offset (53) from the pivot 54) which may be changed according to other weight selection and deployment. Furthermore, the majority (70 to 90 percent) of the supplemental weight 140 is mounted to the gate arm section 52C generally away from the pivot 54, such that when the gate arm 52 is lowered, the bulk of the supplemental weight is closest to the horizontal surface 58. It is found that since the weight of the constituent sections 52A, 52B and 52C of the gate arm are generally distributed over their lengths and that the additional hardware (e.g. pulleys 68, 94, etc.) do not provide a significant lumped mass, the lowering of the gate arm 52 according to the present invention is facilitated by the supplemental weight disposed as indicated, with a typical lumped weight of 69.75 pounds for the weights disposed according to the present embodiment, but may be varied according to a different selection and disposition of weights 130, 132, 134, 136, and 138 made according to the present invention.

Figure 5A:
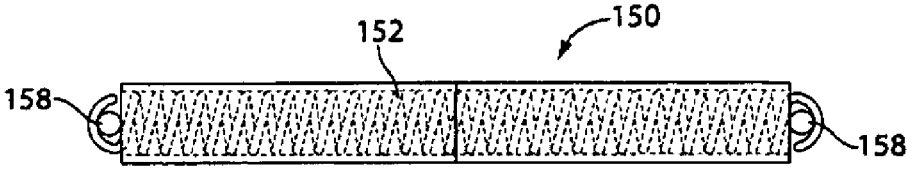
FIG. 5A is a plan view of one embodiment of the gate tip flexing member.
Figure 5B:
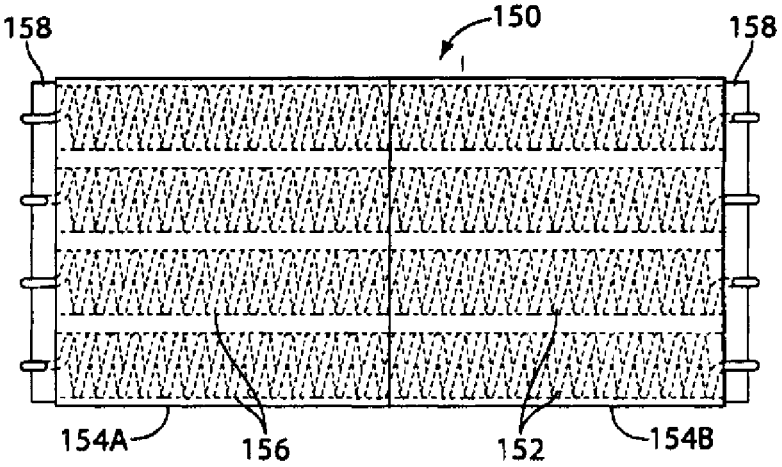
FIG. 5B is a side elevation view of one embodiment of the gate tip flexing member.
Figure 5C:
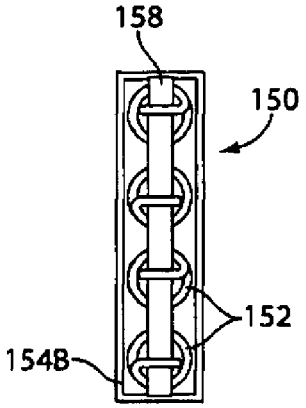
FIG. 5C is an end elevation view of one embodiment of the gate tip flexing member.
Figure 5D:
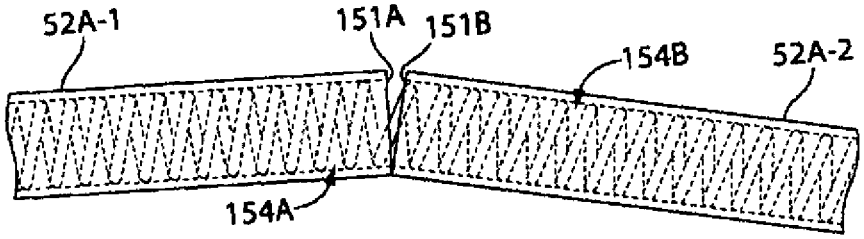
FIG. 5D is a plan view of one embodiment of the gate tip flexing member in a tubular gate section with partial horizontal deflection thereof.
Figure 5E:
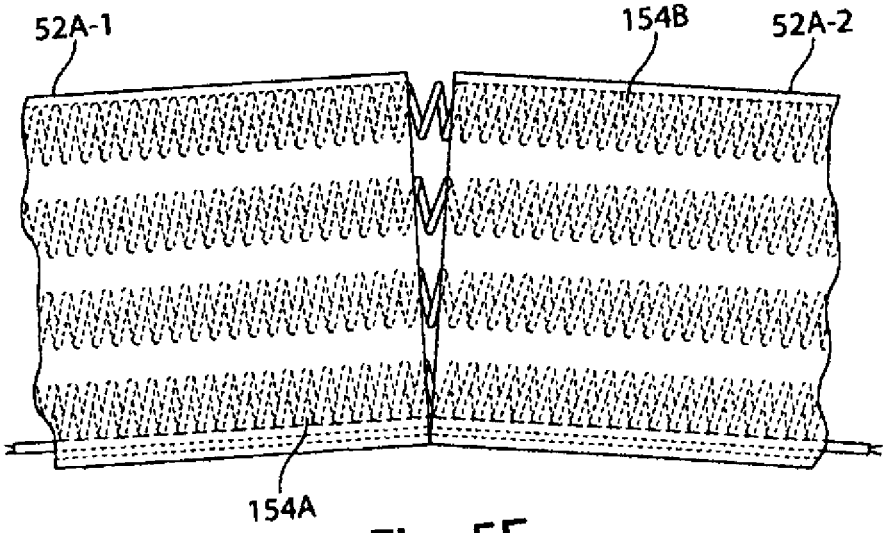
FIG. 5E is a side elevation view of one embodiment of the gate tip flexing member in a tubular gate section with partial vertical deflection thereof.

A further inventive concept according to the present invention provides a resilient flexure of the innermost gate section 52A at a point thereon, as shown in FIGS. 5A through 5E, wherein the gate section is bisected into two pieces, 52A-1 and 52A-2 which are resiliently joined with spring hinge 150 and each have flattened confronting surfaces 151A and 151B, respectively. As shown in FIG. 5A and FIG. 5B, the spring hinge 150 has a clear 'home' position to which it reliably returns when surfaces 151A and 151B fully mate, allowing the gate arm sections 52A-1 and 52A-2 to be in axial alignment when extended or retracted. Moreover, the spring hinge 150 is retained within the gate arm sections 52A-1 and 52A-2, which are typically tubular or otherwise having an internal opening. When the distal end of the gate section is forced out of axial alignment (e.g. by a vehicle) in either the horizontal direction as shown by FIG. 5D or in the vertical direction as shown by FIG. 5E, the springs 152 allow the two pieces 154A and 154B of the hinge 150 to be pulled apart with increasing tension on the hinge springs 152, and return together to the home position when the force is removed. The spring hinge 150 includes hinges 152 retained within parallel apertures within each piece 154A and 154B with some tension, which holds end pin 158 in place and holds the pieces 154A and 154B (and therefore gate sections 52A-1 and 52A-2 in axial alignment).

The above described embodiments are exemplary only and are not restrictive of the embodiments or scope of the present invention. For instance, additional or fewer arm sections are movable by and within the scope according to the present invention. Additional counterbalances may be added to the arm or arm connection to the support. Furthermore, the extension and retraction devices taught herein may be used alone or in combination. Also, the connections of the cables and pulleys to the particular ends of the identified age support arms may be read to include connection near to the respective ends such that the dimensions provide the desired arm section movements made according to the invention describe herein, as provided by one of ordinary skill in the art. Furthermore, the use of the reduction of the length of one section of a cable to lengthen another end as describe above, may be accommodated with other movement structures, e.g. a coupled pair of hydraulic cylinders having a constant volume of fluid, wherein shortening the piston excursion of one causing the extension of the other (and vice-versa) is within the scope of the present invention. Further modifications and substitutions by one of ordinary skill in the art are also within the scope of the present invention, which is not to be limited except by the claims which follow.

What is claimed is:

1. A retractable gate, comprising:

a plurality of gate arms sections each section having a first end, a second end, and a length and being relatively disposed in a sequence having the length of said gate arms being substantially parallel, and being relatively movable from retracted position to an adjustable extended position, wherein said first ends are in proximity in said retracted position and wherein said second end of a gate section arm is in proximity to said first end of the next subsequent gate section arm when in said extended position, and wherein said plurality of gate section arms are movable to positions intermediate between said retracted and said extended position;

a support member having thereon a position corresponding to the location of one end of the retractable gate arm sections; and a pivot bearing connecting a first of said retractable gate arm sections to said support at said position wherein said plurality of gate arm sections is movable about said pivot bearing connection through a selected angle relative to said support member, wherein said first ends of said plurality of gate arm sections are proximal to said pivot and said second ends of said plurality of gate arm sections are distal to said pivot when said plurality of gate arms are in said retracted position; and a gate arm section motion device connected to said support member and at least one of said plurality of gate arm sections to provide a motion of at least one of said gate arm sections relative to another of said plurality of gate arm sections as a result of the motion of said plurality of gate arms relative to said support member, wherein said gate arm section motion device further includes a pulley mounted to said second end of said first gate arm section, and a cable connected said support member at an anchor point and connected to said first end of said next subsequent section of said plurality of gate arm sections, wherein an extending motion to said next section is effected as said first section is moved away from said anchor point by angular motion about said pivot point.

2. The retractable gate of claim 1, wherein said next section comprises a second section, said retractable gate further includes a cable connected to said first gate arm section and to a third gate arm section disposed to be extendable from said second section.

3. The retractable gate of claim 2, further including a pulley mounted on the second end of said second gate arm section, and wherein said cable is connected to said first end of said first gate arm section and to said first end of said third gate arm section, wherein an extending motion to said third gate arm section is effected as said first gate arm section is moved away from said anchor point by angular motion about said pivot point.

4. The retractable gate of claim 1, wherein said gate arm section motion device includes a retraction device for effecting a retraction of at least one of said plurality of gates arm sections relative to another of said sections as a result of the motion of said plurality of gate arms relative to said support member.

5. The retractable gate of claim 4, wherein said retraction device comprises a cable connected to at least one of said plurality of gate arm sections and to said support member.

6. The retractable gate of claim 5, wherein said cable is connected to one of the ground, and the side of said support corresponding to the direction opposite to said gate retracted position.

7. The retractable gate of claim 6, wherein said retraction device includes a spring connected to said cable.

8. The retractable gate of claim 5, wherein a second section of said plurality of gate arm sections is extendable and retractable relative to said first gate arm section;

a third section of said plurality of gate arm sections is extendable and retractable relative to said second gate arm section;

said retraction device further includes a pulley mounted to said first end of said second section, and said cable is mounted to the second end of said second section of said plurality of gate arm section, wherein a retracting motion to said third gate arm section is effected as said second gate arm section is retracted toward said first gate arm section.

9. The retractable gate of claim 1, further including a motor assist device connected to provide to at least one of said plurality of gate arm sections a force relative to another of said plurality of gate arm sections.

10. The retractable gate of claim 1, wherein the innermost gate arm section is bisected, further including a resilient spring hinge having two degrees of freedom in dimensions perpendicular to the longest dimension of said innermost gate.

11. The retractable gate of claim 10, wherein said resilient spring hinge comprises, two mating sections having a flattened confronting surface and a plurality of collinear parallel longitudinal recesses;

a plurality of springs, each disposed within one of said longitudinal recesses; and spring end retainers for captivating said springs within said longitudinal recesses, wherein, said springs are retained under tension when said flattened confronting surfaces are in confronting contact, and said tension increases as said confronting surfaces are moved from said confronting contact.

12. A dynamically balanced gate generally disposed to selectively span a selected horizontal distance over the ground while in a first position, and to be movable into a second position wherein said gate is clear of said selected horizontal distance, comprising:

an arm having a pivot point disposed a fixed distance from a first end of said arm and a variable longer distance from a second end of said arm extendable along a length, wherein said pivot point is disposed along a horizontal axis to permit said first end to be lowered and said second end to be simultaneously raised, a vertical axis extends from said pivot point vertically downward as defined by gravity, said ground being disposed generally orthogonal to said vertical axis, and wherein at least a portion the length of said arm disposed toward said second end is offset from said vertical axis in a first direction when said second end is maximally distal from said ground;

a counterweight disposed on said arm disposed toward said first end from said Divot point having a majority of weight offset from said vertical axis in said first direction, and disposed relative to said first end in said first direction to include a portion thereof offset from said vertical axis in said first direction in the majority of a range of motion between said gate first and said gate second position.

13. The gate of claim 12, further including a supplemental weight mounted on said arm disposed toward said second end of said arm from said pivot point.

14. The gate of claim 13, wherein said supplemental weight is mounted a fixed distance relative to said pivot point.

15. The gate of claim 12, wherein a first ft-lb moment is produced by said first end of said gate relative to said pivot point, and a second ft-lb moment is produced by said second end of said gate relative to said pivot point, said second ft-lb moment being greater than said first ft-lb moment over the range of motion of said gate from between and including said first and second gate positions.

* * * * *

UNITED STATES PATENT AND TRADEMARK OFFICE

CERTIFICATE OF CORRECTION

PATENT NO. : 7,384,017 B1
APPLICATION NO. : 11/150702
DATED : June 10, 2008
INVENTOR(S) : Thomas J. Burke and John Dinunzi It is certified that error appears in the above-identified patent and that said Letters Patent is hereby corrected as shown below:

The title page showing an illustrative figure, should be deleted and substitute therefor the attached title page.

Delete drawing sheets 1-6 and substitute therefor the drawing sheets consisting of sheet 1-7 as shown on the attached pages.

Signed and Sealed this

Nineteenth Day of May, 2009

John Doll

JOHN DOLL
*Acting Director of the United States Patent and Trademark Office*

(12) United States Patent
Burke et al.

(10) Patent No.: US 7,384,017 B1
(45) Date of Patent: Jun. 10, 2008

(54) RETRACTABLE GATE

(75) Inventors: Thomas J. Burke, Whitehouse Station, NJ (US); John Dinunzi, Easton, PA (US)

(73) Assignee: Safe-Crossings, LLC, Newark, NJ (US)

( * ) Notice: Subject to any disclaimer, the term of this patent is extended or adjusted under 35 U.S.C. 154(b) by 355 days.

(21) Appl. No.: 11/150,702

(22) Filed: Jun. 13, 2005

(51) Int. Cl.
*B61L 23/00* (2006.01)

(52) U.S. Cl. ..... 246/125; 246/127; 246/293; 49/49

(58) Field of Classification Search ..... 246/473.1, 246/293, 294, 125, 127; 49/49, 34, 332
See application file for complete search history.

(56) References Cited

U.S. PATENT DOCUMENTS 494,390 A 3/1893 Smith
1,536,360 A * 5/1925 Stewart ..... 49/324
1,628,651 A * 5/1927 Burress ..... 49/9
4,666,108 A 5/1987 Fox
6,142,426 A 11/2000 Zart et al.
6,189,839 B1 * 2/2001 Lemieux ..... 246/293
6,618,993 B2 9/2003 Burke
2005/0139730 A1 * 6/2005 Zarkades ..... 246/473.1

* cited by examiner

*Primary Examiner*—Mark Le
(74) *Attorney, Agent, or Firm*—Joanne M. Martin

(57) ABSTRACT

A retractable gate comprising a movable arm gate having multiple sections which nest or telescope into each other when parked (e.g. upright), and extends into a full length blocking position as it is deployed. The gate arm sections are deployed by the movement of one of the arms, e.g. the outer one section, relative to the ground or a stationary support member and is joined to the stationary support member by a pivot point or bearing, and is connected to the stationary support or ground by a cable connection (or equivalent) which powers the arm sections into extended or retracted positions by movement of the gate about the pivot bearing. A novel corresponding counterweight system provides selectable balance and torque requirements.

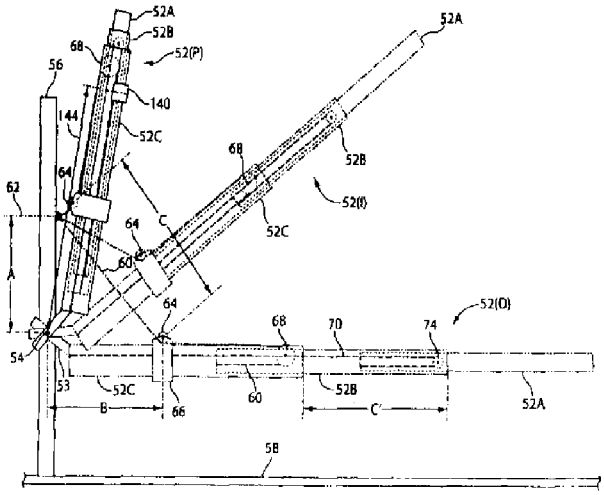

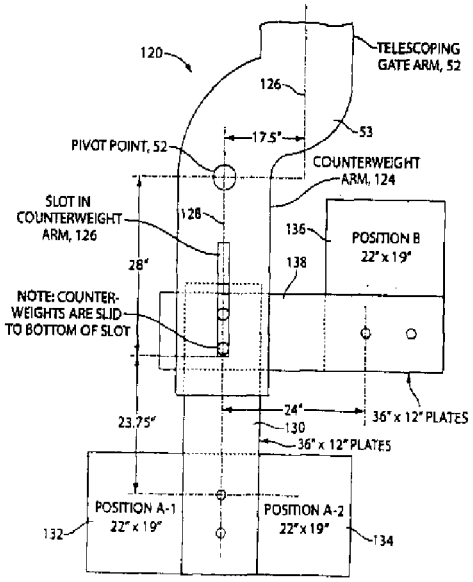

15 Claims, 6 Drawing Sheets